United States Patent [19]

Stanelle

[11] 4,040,218

[45] Aug. 9, 1977

[54] VESSEL WITH AN UPRIGHT SHELL

[76] Inventor: Karl-Heinz Stanelle, Rosenstrasse 4, Guglingen 2, Germany, 7129

[21] Appl. No.: 751,745

[22] Filed: Dec. 17, 1976

[30] Foreign Application Priority Data

June 18, 1976 Germany ..... 2627290

[51] Int. Cl.[2] ..... E04H 7/22; B67D 5/06

[52] U.S. Cl. ..... 52/194; 52/245; 222/185

[58] Field of Search ..... 52/192–197, 52/245–249; 222/185, 486, 459; 220/1 B

[56] References Cited

U.S. PATENT DOCUMENTS

| | | | |
|---|---|---|---|
| 638,280 | 12/1899 | Robinson et al. | 52/194 |
| 1,610,824 | 12/1926 | Venable | 52/194 |
| 2,703,069 | 3/1955 | Dueringer | 52/194 X |
| 3,038,566 | 6/1962 | Parsons | 52/194 |
| 3,248,024 | 4/1966 | Keathly | 222/459 |
| 3,658,211 | 4/1972 | Kitchens | 52/194 X |
| 3,742,664 | 7/1973 | Reding | 52/194 |

FOREIGN PATENT DOCUMENTS

| | | | |
|---|---|---|---|
| 2,257,170 | 6/1973 | Germany | 52/194 |

*Primary Examiner*—J. Karl Bell
*Attorney, Agent, or Firm*—Peter K. Kontler; John Kurucz

[57] ABSTRACT

A vessel, particularly a silo, has an upright shell of circular outline wherein a median part supports an upper part and rests on a lower part. Each of the upper and median parts consists of four arcuate sections which are secured to each other by strips or bars and screws, and the lower portion of the lower part tapers downwardly toward the axis of the shell. The upper portion of the lower part is a collar including a ring of triangular cross section which supports the median part and rests on four ground-contacting supports. The collar consists of four arcuate sections which abut against each other in planes including the axis of the shell and are secured to each other by upright T-bulb-section bars each having two flanges which are secured to the outer sides of neighboring sections of the collar by vertical rows of screws and a bulb which is remote from the collar and is located between the respective rows of screws to afford access to such screws. The supports include profiled upright bars and plates inserted between the upper end portions of the support bars and the respective T-bulb-section bars. If the cylindrical outer portion of the ring of the collar extends upwardly beyond the other portions of the ring, the means for securing the sections of the collar to each other further comprises additional upright T-bulb-section bars each of which is mirrow symmetrical to the respective outer T-bulb-section bar and is screwed to the adjacent sections of the cylindrical portion above the other portions of the ring. The center of gravity of each support is disposed below and in vertical alignment with the point where the inner side of the respective outer T-bulb-section bar intersects the corresponding plane of abutment of neighboring collar sections.

15 Claims, 2 Drawing Figures

VESSEL WITH AN UPRIGHT SHELL

BACKGROUND OF THE INVENTION

The present invention relates to vessels in general, especially to silos, bins or other types of relatively large upright vessels having a circular outline. More particularly, the invention relates to improvements in relatively large, heavy and bulky vessels which must be transported in dismantled condition for assembly at the locale of use. Such large vessels are often used for ensilage of sand, gravel or other building materials. Each section of a relatively large silo is an extremely heavy and bulky component whose transport and manipulation often present serious problems.

SUMMARY OF THE INVENTION

An object of the invention is to provide a novel and improved vessel which can be used for ensilage of granular or like materials and whose components are constructed and assembled in such a way that they can be readily stored in a small area and conveniently transported to or from the locale of use.

Another object of the invention is to provide a vessel whose components include a substantial number of similar sections which contributes to lower manufacturing cost.

A further object of the invention is to provide a vessel of modular construction which can stand substantial stresses including the weight of its components, the weight of the material which is confined in its interior, and/or others, An additional object of the invention is to provide novel and improved means for securing the sections of the vessel to each other.

Another object of the invention is to provide novel and improved means for supporting the vessel at the locus of use.

An ancillary object of the invention is to provide novel and improved means for connecting the shell of the vessel to the ground-contacting supports.

A feature of the invention resides in the provision of a vessel, particularly a silo, which comprises an upright shell having a generally circular outline and including a first part (which is preferably the median part of the shell) and a second or lower part disposed below and supporting the first part. The lower part has a collar which includes several (preferably four) arcuate sections extending circumferentially of the shell and abutting against each other in planes which include the axis of the shell. The vessel further comprises means for securing the neighboring sections of the collar to each other, and such securing means includes an upright profiled bearing member (preferably a T-bulb-section bar) for each plane. Each bearing member has an inner portion, preferably consisting of two mirror symmetrical flanges, which overlies the respective sections of the collar from without and a narrower outer portion (which constitutes the bulb of a T-bulb-section bar) which is remote from the collar. The securing means further includes screws or analogous fasteners which attach the inner portion of each bearing member to the respective sections of the collar and form two vertical rows, one at each side of the respective plane. The outer portion of each bearing member is located between the respective rows of the fasteners. The vessel further comprises ground-contacting support means for the bearing members.

Each securing means preferably further includes a strip for each plane; such strips are located at the inner side of the collar and overlie the abutting portions of the respective sections of the collar. Screws or analogous fasteners are provided to secure the strips to the adjacent collar sections.

The novel features which are considered as characteristic of the invention are set forth in particular in the appended claims. The improved vessel itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
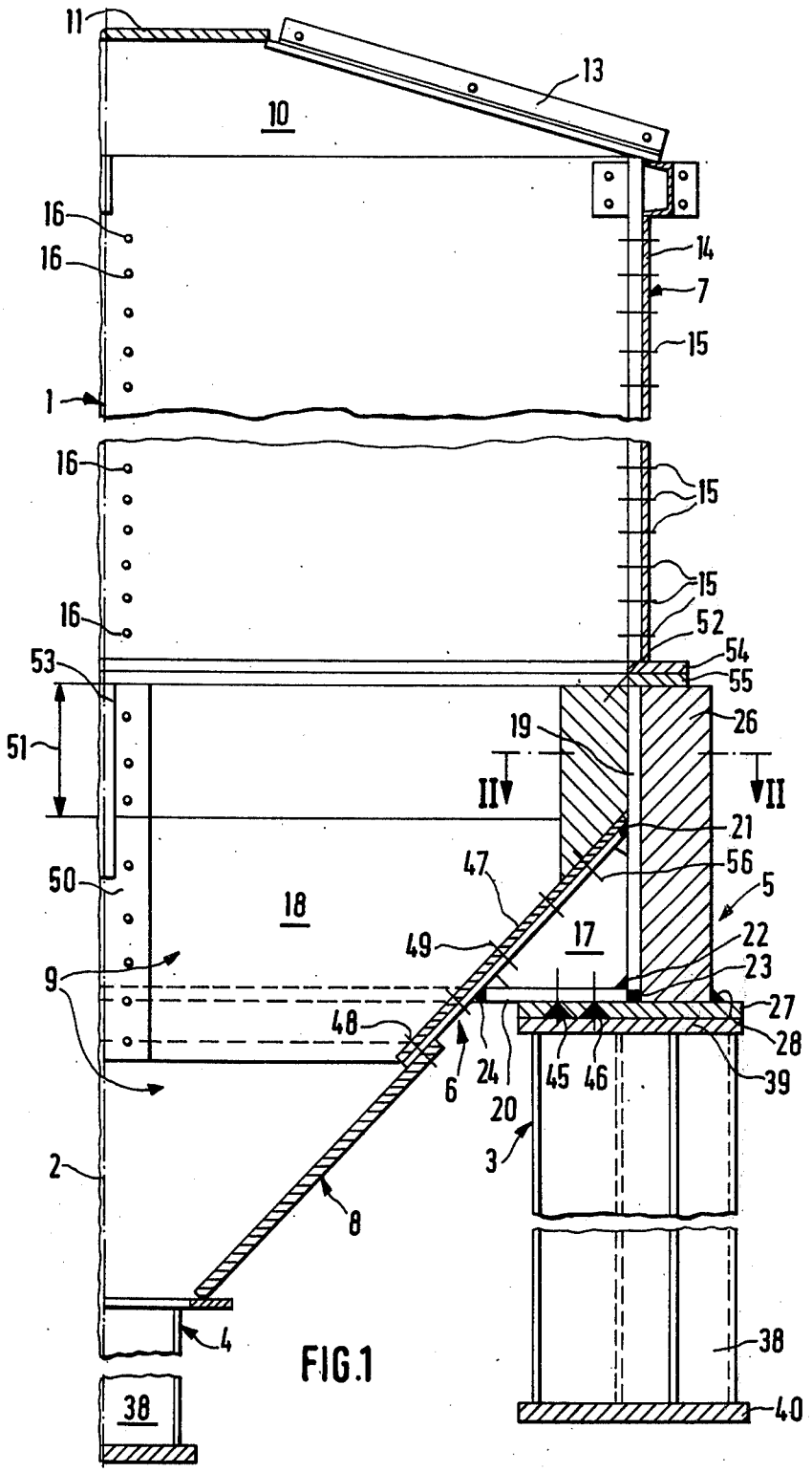
FIG. 1 is a fragmentary central vertical sectional view of a vessel which embodies the invention.

The drawing shows a portion of an upright substantially cylindrical vessel 1 which may constitute a silo or bin for storage of gravel, sand, other building materials or any other substances requiring short-lasting or longer-lasting ensilage. The vertical symmetry axis of the vessel 1 is shown at 2, and the enclosure or shell of the vessel (including its top, median and lower parts) is assembled of modules each of which extends along an arc of 90°. The shell rests on four ground-contacting supports two of which are shown in FIG. 1, as at 3 and 4. The supports are equally spaced from each other, as considered in the circumferential direction of the vessel. Each support carries an upright bearing member 5 which is rigid with an annular collar 6 constituting a component of the funnel-shaped lower part 9 of the shell. The lower part 9 carries a circular cylindrical median part 7 which, in turn, supports the conical upper part 10 having a centrally located cover or lid 11. The lower end portion of the median part 7 has an outwardly extending annular flange 54 which rests on and is secured to a complementary flange 55 of the collar 6 by means of screws, bolts and nuts, or analogous fasteners. The lower part 9 includes the collar 6 and a downwardly tapering conical portion 8 having a sealable outlet for confined material.

In accordance with a feature of the invention, each of the parts 7 and 10 of the enclosure of the vessel 1 is assembled of at least two (in the illustrated embodiment four) prefabricated sections or modules which can be readily connected to or separated from each other at the locus of use. Each section extends along an arc of 90 degrees, as considered in the circumferential direction of the shell including the parts 9, 7, 10. Each of the four supports (including the supports 3 and 4), each of the four bearing members 5, and the cover 11 constitutes an additional prefabricated section or module. In the illustrated embodiment, only the collar 6 of the lower part 9 consists of four arcuate modules; the conical portion 8 is a separate one-piece module which is separably fastened to the smaller-diameter lower end portion of the collar 6. The plane of FIG. 1 is the plane where the two rear modules of each of the parts 7, 10, collar 6 and cylindrical portion 19 of the collar abut against the respective front modules, and the plane which is normal to the plane of FIG. 1 and includes the axis 2 is that plane in which the left-hand modules (not shown) abuts against the right-hand modules. The means for securing the neighboring sections or modules of the top part 10 to each other comprises four inverted T-shaped metallic bars 13 whose flanges are affixed to the respective modules by screws, bolts and nuts, or similar fasteners (not specifically shown). Additional securing means are provided to connect the neighboring modules of the part 7 and the neighboring modules of the collar 6 to each other. The securing means between the modules of the median part 7 include suitably bent trough-shaped members or strips 14 which overlie the abutting vertical surfaces of such modules and are connected to the respective modules by screws or analogous fasteners (indicated by horizontal phantom lines 15). The means for securing the illustrated module of the median part 7 to the module which is located to the left of the axis 2 of FIG. 1 includes a trough-shaped member or shell (not shown) which corresponds to the member 14 and two rows of screws or analogous fasteners. The shanks of the right-hand row of screws are indicated at 16.

Figure 2:
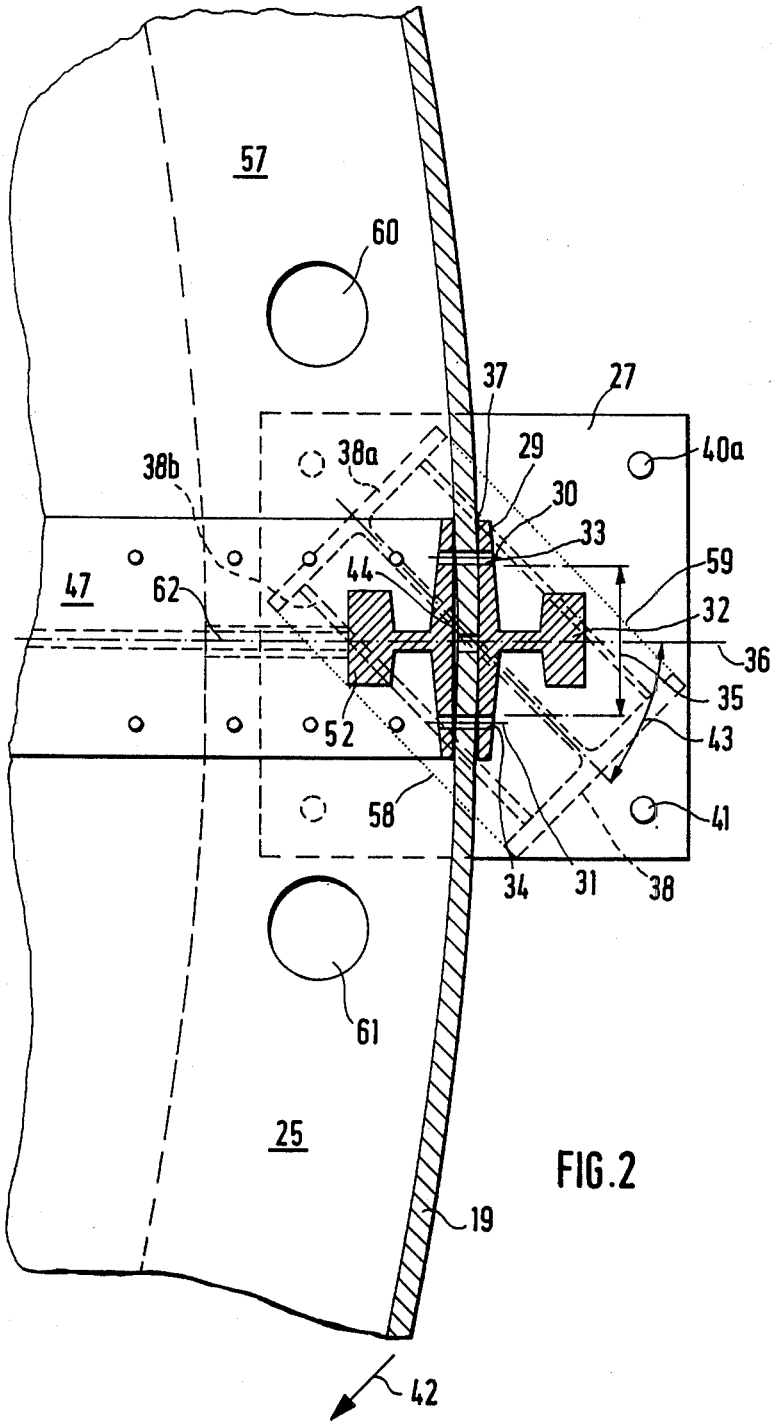
FIG. 2 is an enlarged fragmentary horizontal sectional view as seen in the direction of arrows from the line II—II of FIG. 1.

The collar 6 includes a ring 17 of triangular cross-sectional outline the conical inner portion 18 of which is secured to the portion 8 of the lower part 9, the outer portion of which is the aforementioned cyclindrical portion 19 of the part 9 (the portion 19 is flush with the upper part 7), and the bottom portion of which is a washer-like member 20. The sections of elements 18, 19, 20 which form the ring 17 are permanently secured to each other by welding, as at 21, 22, 23 and 24. The bearing member 5 is secured to the collar 6 by screws or analogous fasteners in the region of abutment of the illustrated section or module of the part 7 with the module which is located in front of the plane of FIG. 1. Two of the modules of which the collar 6 is assembled are shown in FIG. 2 (at 25 and 57). The placing of bearing members 5 in regions where the modules of the part 7 and collar 6 abut against each other renders it possible to effectively transmit stresses, including the weight of the assembled vessel, to the respective supports. Each support carries an equal share of the weight of the assembled shell, and these supports also share all other stresses to which the fully assembled vessel is subjected at the locus of use.

The illustrated bearing member 5 includes an upright bar 26 having a modified T-bulb section (similar bars are used as rails for cranes or the like). The lower end portion of the bar 26 is welded to a polygonal plate 27 (as at 28) and its inner portion (consisting of two flanges 29) is secured to the respective sections of cylindrical portion 19 by at least two rows of screws, bolts or analogous fasteners (the screws of two of these rows are indicated in FIG. 2 by horizontal lines 30 and 31). Those areas of sections of the cylindrical portion 19 which are overlapped by the flanges 29 are shown at 44. The thickness of the outer portion or bulb 32 of the bar 26 exceeds the thickness of the flanges 29 and its width, as considered in the circumferential direction of the vessel 1, is less than the distance between the illustrated rows of screws 30 and 31. This insures that the screws 30 and 31 are readily accessible for removal or that the tapped holes 33, 34 for such screws are accessible when the vessel is to be assembled. FIG. 2 shows that the distance 35 between the two rows of screws 30 and 31 exceeds (preferably substantially) the width of the bulb 32. The relatively small width of the bulb 32 further allows for the application of inserts (not shown) which are used to place the holes of the flanges 29 into exact register with the tapped holes 33, 34 prior to insertion and rotation of the screws 30, 31. The bar 26 is preferably compact to insure satisfactory transfer of weight to the respective support (3 in FIGS. 1 and 2), and this bar has two halves which are mirror symmetrical to each other with reference to a plane 36 which includes the axis 2 of the vessel 1 and is located in the plane of FIG. 1. Each of these halves includes a relatively long flange (29) adjacent the collar 6, a shorter flange (one-half of the bulb 32) and a web which extends radially of the collar 6. The locus where the sections of portion 19 of the ring 17 abut (or almost abut) against each other is disposed in the plane 36. The intersection of plane 36 with the line 37 of contact between a flange 29 of the bar 26 and the respective section of cylindrical portion 19 is located above the center of gravity of the support 3.

The support 3 includes an upright profiled bar 38 whose cross-sectional outline is shown in FIG. 2 by broken lines. The bar 38 has two upright end plates **38*a* and three parallel upright traverses 38*b* between the end plates 38*a*. The upper and lower end portions of the bar 38 are respectively welded to horizontal platens 39 and 40. The platen 39 is in register with the plate 27 and is secured thereto by several screws or analogous fasteners, e.g., one at each of the four corners. The heads of two of these fasteners are shown in FIG. 2, as at 40*a* and 41**.

The inclination of traverses **38*b* relative to the plane 36 is indicated at 43; the angle between the planes of the traverses 38*b* and the plane 36 is preferably a large acute angle (e.g., 45°). Such orientation of the bar 38 provides more room for vehicles (see the arrow 42). It should be borne in mind that the illustrated vessel may have a diameter of several meters and that the height of the bars 38 is normally sufficient to allow for the passage of large conveyances (e.g., trucks) at a level below the platens 39. The bars 38 of the other three supports (see the bar 38 of the support 4 in the lower left-hand portion of FIG. 1) are preferably oriented in the same way as the bar of the support 3, i.e., they make acute angles with the respective symmetry planes (corresponding to the symmetry plane 36 for the bar 38 of the support 3). On the other hand, the four bearing members 5 are preferably disposed radially of the vessel, i.e., so that the symmetry planes (corresponding to the symmetry plane 36 of FIG. 2) halve the respective bars 26 in the same way as shown for the bar 26 of FIG. 2. The cross-section of each bar 26 is sufficiently small to insure that the bar can be placed within the outline (indicated in FIG. 2 by dotted lines 58, 59) of the corresponding support bar 38. FIG. 2 further shows that the sections 25 and 57 are respectively formed with openings 61, 60 which are large enough to enable the workmen to reach into the interior of the ring 17** in order to facilitate the application or removal of various fasteners.

The left-hand half of the plate 27, as viewed in FIG. 2, extends radially inwardly of the associated bearing member 5 and is secured to the washer-like bottom portion 20 of the ring 17 by screws, bolts or analogous fasteners indicated in FIG. 1 by vertical lines 45 and 46.

The inner side of conical portion 18 of the ring 17 is overlapped by a strip 47 overlying the line 62 of abutment between the corresponding modules of the collar 6 and secured to such modules and to portion 8 by screws or analogous fasteners. Some of these fasteners are shown at 48, 49 and 56. One-half of a second strip, which overlies the line of abutment between the illustrated module of the collar 6 and the module to the left of the symmetry axis 2 is shown in FIG. 1 at 50. The sections of the cylindrical portion 19 which abut in the plane 36 are disposed between the flanges 29 of the aforementioned bar 26 and similar flanges of a second or inner bearing member 52 here shown as a T-bulb-section bar. The latter is also located within the outlines of the respective support bar 38. The bar 52 is adjacent to the inner side of that part of the cylindrical portion 19 of the ring 17 which is located immediately below the flange 55, i.e., above the portions 18 and 20 of the ring 17. The bar 52 is shorter than but otherwise a mirror symmetrical replica of the adjacent outer bar 26. It is preferred to form the flanges 29 of the bar 26 with holes which register with the holes of flanges forming part of the inner bar 51 so that the fasteners 30, 31 can be used to secure the flanges 29 to the sections of cylindrical portion 19 as well as the flanges of the bar 52. This can be readily achieved by providing the flanges of the bar 52 with tapped holes so that a screw which passes through the holes 33, 34 of the flanges 29 and portion 19 can mesh with the flanges of the bar 52. Also, one can resort to bolts and nuts. A portion of a second inner T-bulb-section bar is shown in FIG. 1, as at 53.

The manner in which the other sections or modules of the parts of the shell of the vessel 1 are secured to each other is preferably identical with the aforedescribed manner of connecting the sections shown in FIGS. 1 and 2. The only difference is that the angle 43 for the bar 38 of the support 4 and the support located diametrically opposite the support 4 is located at the other side of the respective symmetry plane 36. In each instance, the point of intersection of the line 37 and the corresponding symmetry plane is located above the center of gravity of the respective support. Such center of gravity is disposed in the central plane of the median traverse **38*b* of each bar 38.**

If desired, the height of the collar 6 can be reduced by the distance 51 shown in FIG. 1. The flange 54 is then located immediately above the conical portion of the lower part 9. In such modified vessel, the inner bars 52 and 53 can be dispensed with.

The bearing members 5 are preferably assembled with the associated plates 27 prior to transport to the location where the vessel is to be erected. This contributes relatively little to the bulk of such parts because each bearing member 5 is a relatively small and compact component. The bearing members 5 perform several functions, i.e., their flanges 29 are functional equivalents of the strips 14 which connect the sections of the part 7 to each other; in addition, the members 5 transmit the weight of the shell to the respective supports. This contributes to savings in material (particularly fasteners) because the means (30, 31) for connecting the bearing members 5 to the part 9 of the shell also connects the neighboring sections (such as 25 and 57) of the collar 6 to each other. In other words, one saves a set of fasteners for each and every bearing member 5 because, instead of being secured to intermediate portions of collar sections, the bearing members 5 are secured to and thereby couple those marginal regions of the collar sections which abut each other in the respective symmetry planes 36. Were the bearing members 5 secured to the sections of the collar in the manufacturing plant, the weight and bulk of the resulting components would greatly exceed the weight and bulk of a section 25 or 57.

An advantage of plates 27, which extend inwardly beyond the respective bearing members 5, is that the inner portions of such plates can be fastened directly to the washer-like portion 20 of the ring 17. Thus, there is no need to utilize the strips, bars or analogous elements for attachment of plates 27 to the lower part 9 of the shell. The fastening of bearing members 5 to the other side of the portion 19 of ring 17 and the fastening of inner portions of plates 27 to the bottom portion 20 of the ring 17 contributes significantly to rigidity of the assembled vessel. Such rigidity is especially pronounced in the region of each symmetry plane 36, i.e., in regions where the sections of the collar 6 abut against each other.

It is preferred, at the present time, to utilize fasteners in the form of screws, bolts, bolts and nuts, or similar elements which can be applied or removed by resorting to relatively simple tools. This renders it possible to complete the assembly or dismantling of a relatively large vessel within surprisingly short intervals of time. Moreover, the vessel can be assembled or dismantled by semiskilled workers because there is no need for welding equipment and skilled welders since all such parts which must or should be welded to each other are preferably assembled in the manufacturing plant. The absence of welded seams in the means for securing the sections or modules of the vessel to each other also results in simplification of the task of dismantling the vessel (if and when necessary).

The combined weight of all sections or modules of the improved vessel can be well in excess of 30 tons. In order to allow for convenient transport to the locale of use (e.g., by means of helicopters if the intended locus of use is not readily accessible), the weight of each module is preferably less than two tons. Of course, and especially if the vessel is to be assembled at a site which is readily accessible by land vehicles or by watercraft, each module can weigh well in excess of two tons. All components of the vessel may but need not be made of a metallic material, and some or all of the parts can be subjected to special treatment to readily withstand the corrosive effect of the confined material and/or the surrounding atmosphere.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. A vessel, particularly a silo, comprising an upright shell having a generally circular outline and including a first part and a second part disposed below and supporting said first part, said second part having a collar including several arcuate sections extending circumferentially of said shell and abutting against each other in planes including the axis of said shell; means for securing the neighboring sections of said collar to each other, including an upright profiled bearing member for each of said planes, each of said bearing members having a relatively wide inner portion overlying the respective sections of said collar from without and a narrower outer portion, and means for fastening said inner portion to the respective sections, said fastening means forming two rows and said outer portion of each bearing member being disposed between the respective rows of fastening means; and ground-contacting support means for said bearing members.

2. A vessel as defined in claim 1, wherein said collar consists of four sections each of which extends along an arc of substantially 90°.

3. A vessel as defined in claim 1, wherein said securing means further comprises a strip for each of said planes, each of said strips overlying the respective neighboring sections of said collar from within, and means for fastening said strips to the respective sections of said collar.

4. A vessel as defined in claim 1, wherein each of said bearing members is a bar having a T-bulb section, said inner portion of each of said bearing members including two flanges and said outer portion of each of said bearing members constituting the bulb.

5. A vessel as defined in claim 1, wherein the thickness of said outer portion of each of said bearing members exceeds the thickness of the respective inner portion, as considered radially of said shell.

6. A vessel as defined in claim 1, wherein said collar includes a ring having a triangular cross section.

7. A vessel as defined in claim 1, wherein said first part of said shell is a cylinder and said second part includes a conical portion tapering downwardly toward the axis of said shell.

8. A vessel as defined in claim 1, further comprising a substantially horizontal plate disposed intermediate each of said bearing members and the respective support means.

9. A vessel as defined in claim 8, wherein said plates extend inwardly beyond said bearing members and further comprising means for fastening said plates to the adjoining sections of said collar.

10. A vessel as defined in claim 1, wherein each of said bearing members has two mirror symmetrical halves and said bearing members are located within the outlines of the respective support means.

11. A vessel as defined in claim 10, wherein each of said planes is the symmetry plane of the respective bearing member and each of said support means has a center of gravity in vertical alignment with the locus where the inner portion of the respective bearing member contacts said collar in the region of the respective symmetry plane.

12. A vessel as defined in claim 1, wherein each of said bearing members has two mirror symmetrical U-shaped halves each having a longer flange adjacent said collar, a shorter flange remote from said collar and a web extending between said flanges substantially radially of said collar.

13. A vessel as defined in claim 1, wherein said collar includes a ring of triangular cross section, said ring having a cylindrical outer portion in register with said first part of said shell and two additional portions, said cylindrical portion extending upwardly beyond said additional portions and said securing means further comprising an additional upright bearing member for each of said first mentioned bearing members, said additional bearing members being located within said cylindrical portion at a level above said additional portions of said ring opposite the respective first mentioned bearing members, and means for fastening said additional bearing members to the adjacent sections of said cylindrical portion.

14. A vessel as defined in claim 13, wherein said last mentioned fastening means constitutes said first mentioned fastening means.

15. A vessel as defined in claim 13, wherein each of said bearing members has the same profile.

* * * * *